US011965334B1

(12) United States Patent
Alhusain

(10) Patent No.: US 11,965,334 B1
(45) Date of Patent: Apr. 23, 2024

(54) MULTI-LAYER WEDGE ANCHORAGE FOR FIBER-REINFORCED POLYMER (FRP) PLATES AND TENDONS

(71) Applicant: KING FAISAL UNIVERSITY, Al-Ahsa (SA)

(72) Inventor: Mustafa Abdullah Essa Alhusain, Al-Ahsa (SA)

(73) Assignee: KING FAISAL UNIVERSITY, Al-Ahsa (SA)

( * ) Notice: Subject to any disclaimer, the term of this patent is extended or adjusted under 35 U.S.C. 154(b) by 0 days.

(21) Appl. No.: 18/410,441

(22) Filed: Jan. 11, 2024

(51) Int. Cl.
*E04C 5/12* (2006.01)

(52) U.S. Cl.
CPC ..... *E04C 5/122* (2013.01)

(58) Field of Classification Search
CPC ..... E04C 5/12; E04C 5/122; E04C 5/127
See application file for complete search history.

(56) References Cited

U.S. PATENT DOCUMENTS 2,751,660 A 6/1956 Nakonz
3,099,109 A 7/1963 Hahn
3,123,879 A * 3/1964 Boduroff ..... E04C 5/122 403/217
3,263,384 A 8/1966 Middendorf
3,659,321 A 5/1972 Laurent
4,121,395 A * 10/1978 Rudolf ..... B29C 70/86 52/223.13
4,367,568 A 1/1983 Weiser
4,448,002 A 5/1984 Rehm et al.
4,671,034 A 6/1987 Rehm et al.
5,713,169 A * 2/1998 Meier ..... E04C 5/122 403/374.1
6,487,757 B1 * 12/2002 Stubler ..... E01D 19/14 24/115 M (Continued)

FOREIGN PATENT DOCUMENTS

CN 210529517 U 5/2020
DE 955818 C 1/1957

(Continued)

OTHER PUBLICATIONS

Mohee, Faizul M., and Adil Al-Mayah. "Effect of barrel, wedge material and thickness on composite plate anchor performance through analytical, finite element, experimental and 3D prototype investigations." Engineering Structures 175 (2018): 138-154.

(Continued)

*Primary Examiner* — Rodney Mintz
(74) *Attorney, Agent, or Firm* — Nath, Goldberg & Meyer; Richard C. Litman

(57) ABSTRACT

A wedge anchorage includes the components needed to secure three fiber-reinforced polymer (FRP) plates and six FRP tendons. The components include an outer barrel, two inner barrels, two outer wedges, two inner wedges, and two middle wedges. Two sets of three FRP tendons are secured in through holes formed between the respective upper and lower outer wedges and upper and lower inner wedges. A first FRP plate is secured between the upper inner wedge and a middle wedge, while a second FRP plate is secured between the lower inner wedge and the other middle wedge. The third FRP plate is secured between the two middle wedges.

6 Claims, 5 Drawing Sheets

(56) References Cited

U.S. PATENT DOCUMENTS

| | | | | |
|---|---|---|---|---|
| 6,578,329 | B1 * | 6/2003 | Stubler | E04C 5/122 52/223.13 |
| 7,174,684 | B2 * | 2/2007 | Nuetzel | E04C 5/122 52/231 |
| 7,181,890 | B2 * | 2/2007 | Nuetzel | E01D 19/14 52/231 |
| 7,716,800 | B1 * | 5/2010 | Percheron | F16G 11/106 24/122.3 |
| 2005/0034392 | A1 * | 2/2005 | Nuetzel | E04C 5/122 52/223.1 |
| 2005/0066595 | A1 * | 3/2005 | Nuetzel | E01D 19/14 52/223.1 |
| 2020/0157818 | A1 * | 5/2020 | Erdogan | E04C 5/122 |

FOREIGN PATENT DOCUMENTS

| | | | |
|---|---|---|---|
| DE | 1091309 | B | 10/1960 |
| DE | 2512114 | A1 | 9/1976 |
| DE | 2950303 | A1 | 7/1981 |
| DE | 3118220 | A1 | 11/1982 |
| GB | 846346 | A | 8/1960 |

OTHER PUBLICATIONS

Mohee, Faizul M., Adil Al-Mayah, and Alan Plumtree. "Development of a novel prestressing anchor for CFRP plates: Experimental investigations." Composite Structures 176 (2017): 20-32.

* cited by examiner

MULTI-LAYER WEDGE ANCHORAGE FOR FIBER-REINFORCED POLYMER (FRP) PLATES AND TENDONS

BACKGROUND

1. Field

The present disclosure relates to a multi-layer wedge anchorage for fiber-reinforced polymer (FRP) plates and FRP tendons, in particular a wedge anchorage for three FRP plates and six FRP tendons.

2. Description of the Related Art

Concrete and other masonry or cementitious materials typically have high compressive strength but lower tensile strength. Thus, when using concrete as a structural member, for example, in a building, bridge, pipe, pier, culvert, tunnel, or the like, it is conventional to incorporate reinforcing members to impart the necessary tensile strength. Historically, the reinforcing members are steel or other metal reinforcing rods or bars, i.e., "rebar". Such reinforcing members may be placed under tension to form pre-stressed or post-tensioned concrete structures.

Composite reinforcement materials, specifically fiber reinforced polymers (FRP), have been used to strengthen existing concrete and masonry structures. FRP are strong, lightweight, highly durable, and can be easily installed in areas of limited access. These fiber reinforced polymers typically contain a glass or carbon fiber textile that is embedded in a matrix.

SUMMARY

There is a need for an anchorage mechanism to secure fiber-reinforced polymer (FRP) plates and tendons when used to reinforce concrete. The present disclosure is directed to a wedge anchorage that addresses problems encountered in the past when using FRP elements to reinforce concrete.

The present disclosure is directed to a wedge anchorage that includes the components needed to secure three FRP plates and six FRP tendons. The components include an outer barrel, two inner barrels, two outer wedges, two inner wedges, and two middle wedges. Two sets of three FRP tendons are secured in through holes formed between the respective upper and lower outer wedges and upper and lower inner wedges. A first FRP plate is secured between the upper inner wedge and a middle wedge, while a second FRP plate is secured between the lower inner wedge and the other middle wedge. The third FRP plate is secured between the two middle wedges.

In an embodiment, the present disclosure is directed to a wedge anchorage. The wedge anchorage includes a cylindrical outer barrel and an upper inner barrel having an outer surface conforming to and contacting an inner surface of the outer barrel. The wedge anchorage also includes an upper outer wedge having a top surface and a bottom surface, wherein the top surface of the upper outer wedge mates with a bottom surface of the upper inner barrel, and the bottom surface of the upper outer wedge includes three grooves. An upper inner wedge has a top surface and a bottom surface, the top surface includes three grooves whereby, when the top surface of the upper inner wedge is mated with the bottom surface of the upper outer wedge, the three grooves in the bottom surface of the upper outer wedge align with the three grooves in the top surface of the upper inner wedge to form three upper through holes. Three upper fiber-reinforced polymer (FRP) tendons are included, with each of the three upper FRP tendons being located in a respective one of the three upper through holes.

The wedge anchorage includes a first middle wedge and a first FRP plate located between a bottom surface of the upper inner wedge and a top surface of the first middle wedge. Further, the wedge anchorage includes a second middle wedge and a second FRP plate located between a bottom surface of the first middle wedge and a top surface of the second middle wedge. A lower inner wedge has a top surface and a bottom surface, wherein the bottom surface comprises three grooves. A third FRP plate is located between a bottom surface of the second middle wedge and a top surface of the lower inner wedge. A lower outer wedge has a top surface and a bottom surface, wherein the top surface comprises three grooves whereby, when the top surface of the lower outer wedge mates with the bottom surface of the lower inner wedge, the three grooves in the top surface of the lower outer wedge align with the three grooves in the bottom surface of the lower inner wedge to form three lower through holes. Three lower FRP tendons are included, each of the three lower FRP tendons being located in a respective one of the three lower through holes. A lower inner barrel has an outer surface conforming to and contacting an inner surface of the outer barrel, the lower inner barrel includes a top surface, wherein the top surface of the lower inner barrel mates with the bottom surface of the lower outer wedge.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
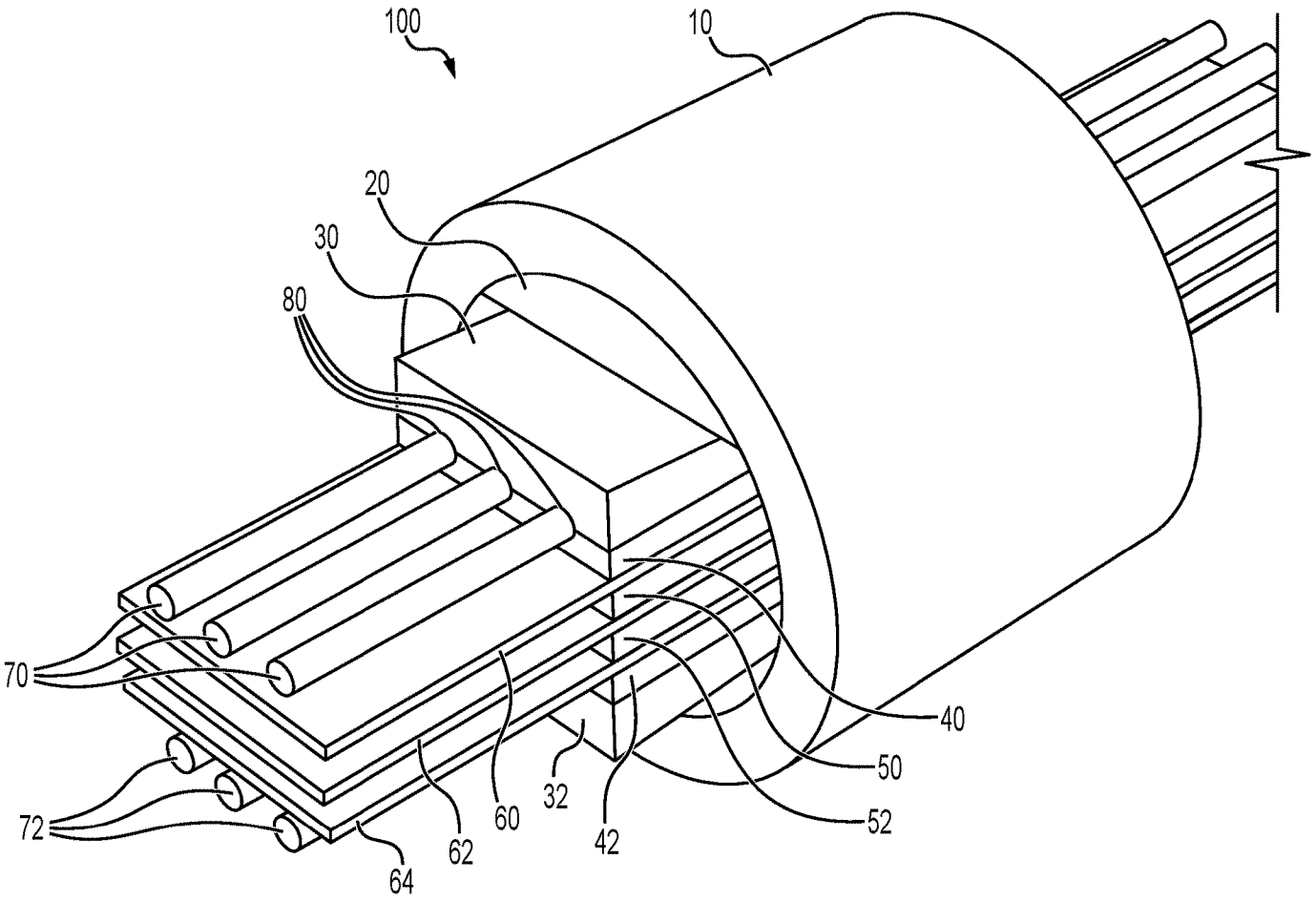
FIG. 1 is a perspective view of a wedge anchorage before presetting the wedges.
Figure 2:
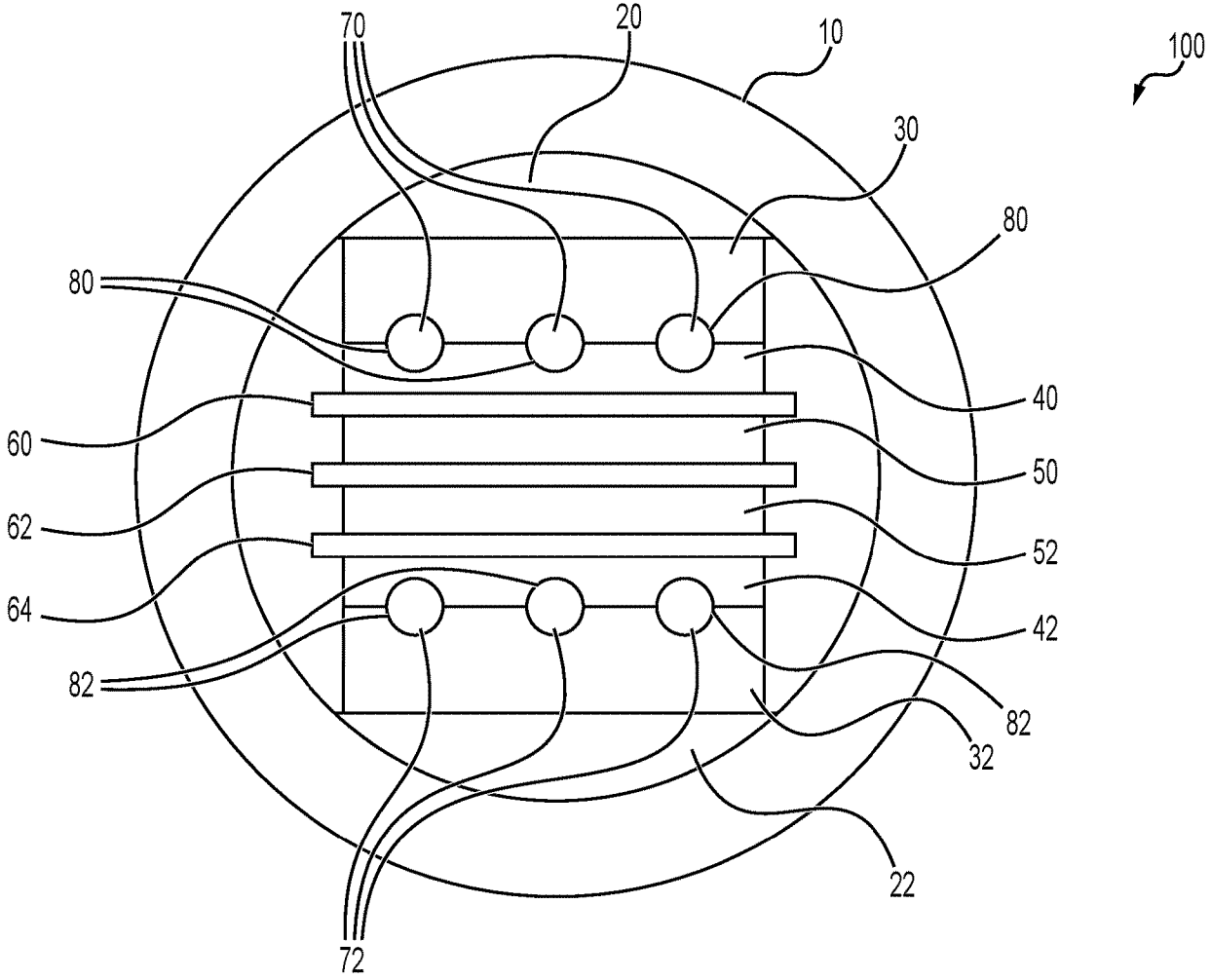
FIG. 2 is a front view of the wedge anchorage of FIG. 1 before presetting the wedges.
Figure 3:
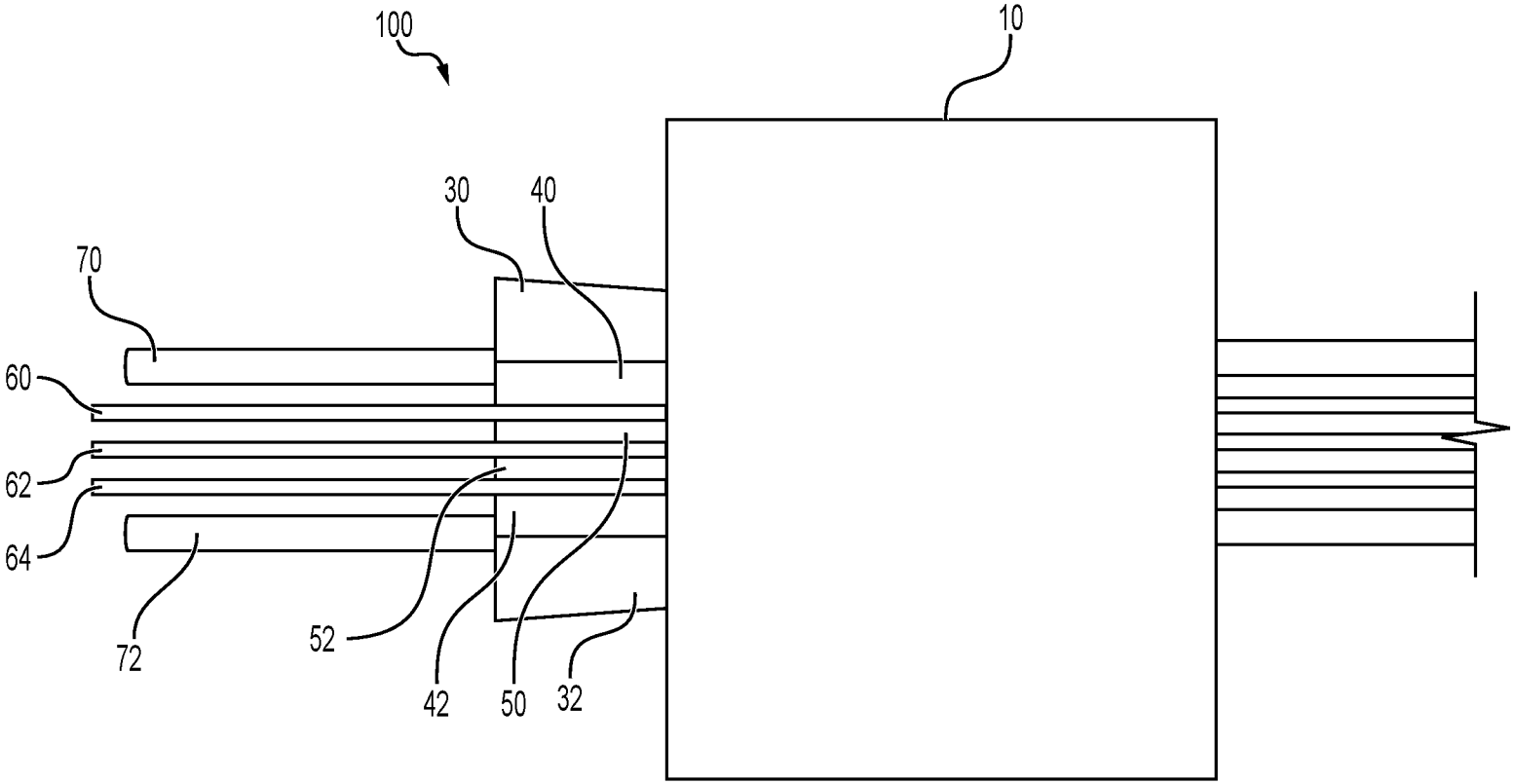
FIG. 3 is a side view of the wedge anchorage of FIG. 1 before presetting the wedges.

It should be understood that the drawings described above or below are for illustration purposes only with emphasis generally being placed upon illustrating the principles of the present teachings. The drawings are not intended to limit the scope of the present teachings in any way.

Throughout the application, where compositions are described as having, including, or comprising specific components, or where processes are described as having, including, or comprising specific process steps, it is contemplated that compositions of the present teachings can also consist essentially of, or consist of, the recited components, and that the processes of the present teachings can also consist essentially of, or consist of, the recited process steps.

It is noted that, as used in this specification and the appended claims, the singular forms "a", "an", and "the" include plural references unless the context clearly dictates otherwise. The use of the terms "include," "includes", "including," "have," "has," or "having" should be generally understood as open-ended and non-limiting unless specifically stated otherwise.

The present disclosure is directed to a wedge anchorage for use with fiber-reinforced polymer (FRP) plates and tendons in reinforced concrete. FRP materials are composite materials that are typically comprised of strong fibers embedded in a resin matrix. The fibers provide strength and stiffness to the composite and generally carry most of the applied loads. The matrix acts to bond and protect the fibers and to provide for transfer of stress from fiber to fiber through shear stresses. The most common fibers are glass, carbon, and synthetic fibers. FRP composites have very high strength characteristics and are nonconductive, noncorrosive, and lightweight.

The subject matter of this disclosure is particularly drawn to a wedge anchorage that secures three FRP plates and six FRP tendons. FIGS. 1-5 depict a particular embodiment of the present disclosure and the following description references the various elements and components as shown in the respective figures.

Turning now to FIGS. 1-5, a wedge anchorage 100 includes a cylindrical outer barrel 10. An upper inner barrel 20 has an outer surface conforming to and contacting an inner surface of the outer barrel 10. An upper outer wedge 30 has a top surface and a bottom surface. The top surface of the upper outer wedge 30 mates with a bottom surface of the upper inner barrel 20. The bottom surface of the upper outer wedge 30 includes three grooves.

An upper inner wedge 40 has a top surface and a bottom surface. The top surface of the upper inner wedge 40 includes three grooves. When the top surface of the upper inner wedge 40 is mated with the bottom surface of the upper outer wedge 30, the three grooves in the bottom surface of the upper outer wedge 30 align with the three grooves in the top surface of the upper inner wedge 40 to form three upper through holes 80. The three upper through holes 80 are formed to receive FRP tendons. In a particular embodiment, the three upper through holes 80 each receive one of three upper FRP tendons 70. In an additional embodiment, the three upper through holes 80 are evenly spaced across a width of the bottom of the upper outer wedge 30 and the top of the upper inner wedge 40.

The wedge anchorage 100 also includes a first middle wedge 50 and a second middle wedge 52. A first FRP plate 60 is positioned between a bottom surface of the upper inner wedge 40 and a top surface of the first middle wedge 50. A second FRP plate 62 is positioned between a bottom surface of the first middle wedge 50 and a top surface of the second middle wedge 52.

A lower inner wedge 42 has a top surface and a bottom surface, with the bottom surface having three grooves. A third FRP plate 64 is located between a bottom surface of the second middle wedge 52 and the top surface of the lower inner wedge 42.

A lower outer wedge 32 has a top surface and a bottom surface. The top surface of the lower outer wedge 32 includes three grooves. When the top surface of the lower outer wedge 32 mates with the bottom surface of the lower inner wedge 42, the three grooves in the top surface of the lower outer wedge 32 align with the three grooves in the bottom surface of the lower inner wedge 42 to form three lower through holes 82. The three lower through holes 82 are formed to receive FRP tendons. In a particular embodiment, the three lower through holes 82 each receive one of three lower FRP tendons 72. In an additional embodiment, the three lower through holes 82 are evenly spaced across a width of the bottom of the lower inner wedge 42 and the top of the lower outer wedge 32.

A lower inner barrel 22 has an outer surface conforming to and contacting an inner surface of the outer barrel 10. The lower inner barrel 22 has a top surface. The top surface of the lower inner barrel 22 mates with the bottom surface of the lower outer wedge 32.

In this particular embodiment of the wedge anchorage, FIGS. 1-4 show the wedge anchorage with the three FRP plates and six FRP tendons before a presetting stage (after being assembled together but before being in the final position/configuration). FIG. 5 shows the wedge anchorage with the plates and tendons after the presetting stage, when all of the wedges, plates and tendons are in a final position.

Figure 4:
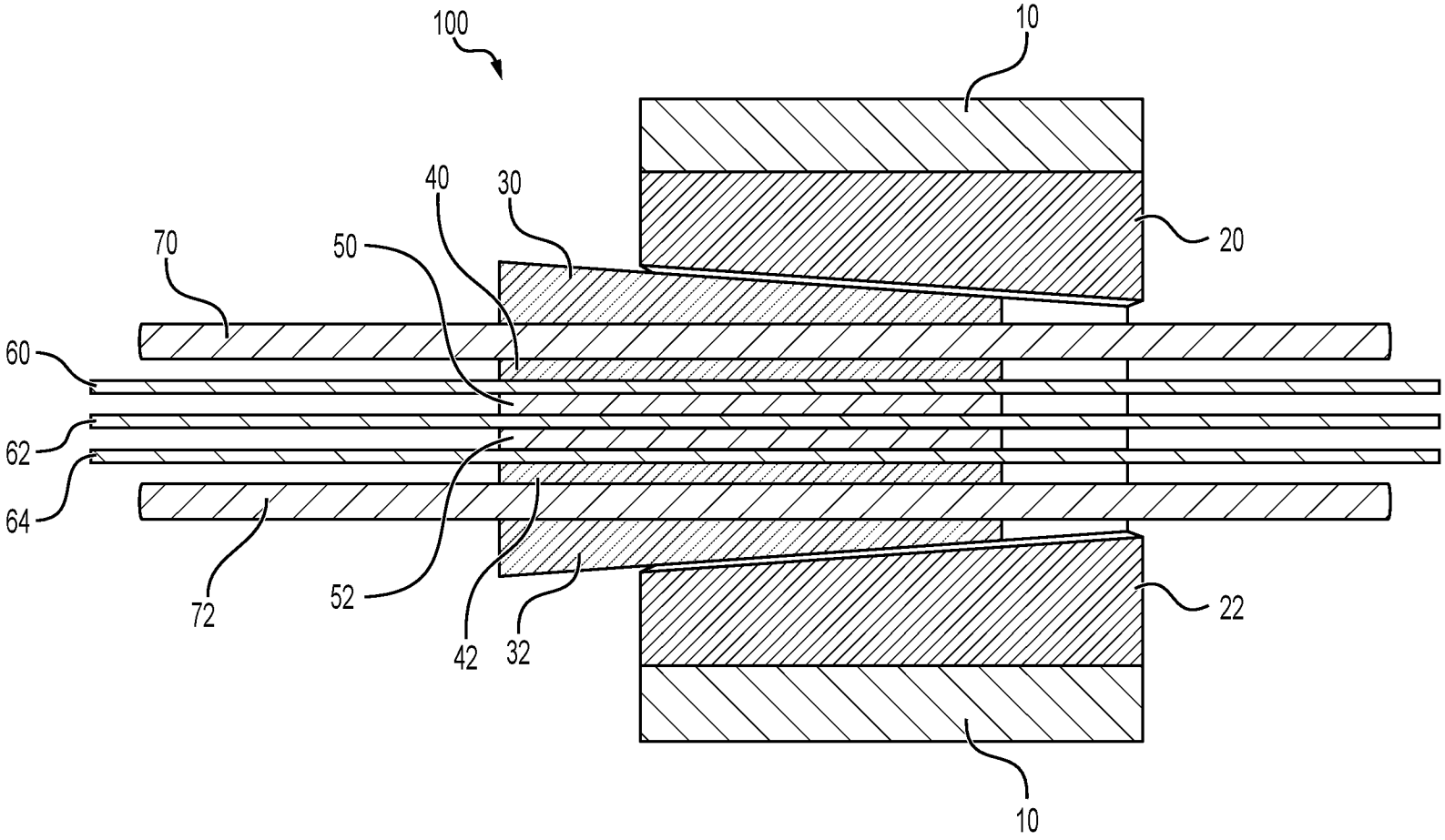
FIG. 4 is a side cross-section view of the wedge anchorage of FIG. 1 before presetting the wedges.
Figure 5:
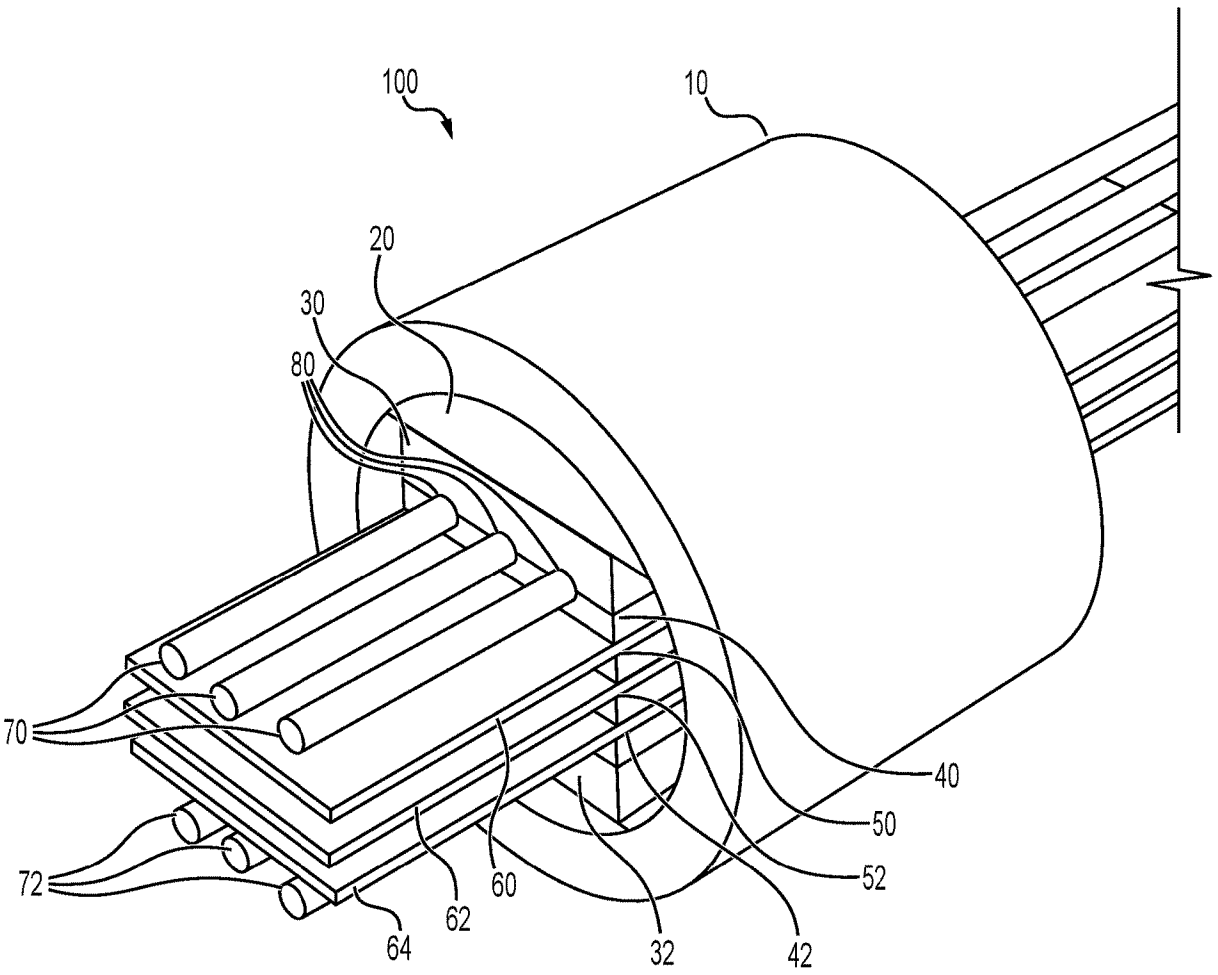
FIG. 5 is a perspective view of the wedge anchorage of FIG. 1 after presetting the wedges.

Turning now specifically to FIG. 4, it is contemplated that each of upper inner barrel 20, upper outer wedge 30, lower outer wedge 32, and lower inner barrel 22 has a thickness that varies in a longitudinal (length-wise) direction. In particular, it can be seen in FIG. 4 that upper outer barrel 20 and inner outer barrel 22 have respective thicknesses that increase along the length of the barrel (as indicated from left to right in the figure). Also, upper outer wedge 30 and lower outer wedge 32 have respective thicknesses that decrease along the length of the wedge (as indicated from left to right in the figure).

Furthermore, as can be seen in FIG. 4, upper outer wedge 30 can have a flat bottom surface and lower outer wedge 32 can have a flat top surface. In addition, each of first middle wedge 50 and second middle wedge 52 can have flat top and flat bottom surfaces. Also, the top surfaces of upper inner wedge 40 and lower inner wedge 42 can be flat, as can be the respective bottom surfaces thereof. It is also shown in FIG. 4 that the upper and lower tendons are located in the respective upper and lower through holes formed by the grooves present in the respective upper and lower outer wedges, as well as the upper and lower inner wedges.

It is further contemplated that upper inner barrel 20 is affixed to an inner surface of outer barrel 10 by any one or more of multiple different methods. In a particular embodiment, upper inner barrel 20 is affixed to the inner surface of outer barrel 10 by welding. Likewise, lower inner barrel 22 is affixed to the inner surface of outer barrel 10 by any suitable method. In a particular embodiment, lower inner barrel 22 is affixed to the inner surface of outer barrel 10 by welding.

It is also contemplated that the components of the wedge anchorage are made of a suitably strong material to secure the FRP plates and tendons. In a particular embodiment, the outer barrel, each inner barrel, and each wedge are made of metal. A non-limiting example of a metal to be used for each component is steel, however any suitable metal material can be used.

In an embodiment, the FRP plates and wedges can be positioned directly between the wedges. In an alternative embodiment, a soft material can be positioned between the plates and the wedges. A non-limiting example of a soft material that can be placed between the plates and wedges is a copper sheath. Furthermore, when assembling the wedge anchorage, a high-pressure lubricant can be applied between the respective mating surfaces of the inner barrels and outer wedges to allow a smooth insertion of the wedges into the anchorage.

It is to be understood that the present subject matter is not limited to the specific embodiments described above but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A wedge anchorage comprising:

a cylindrical outer barrel;

an upper inner barrel having an outer surface conforming to and contacting an inner surface of the cylindrical outer barrel;

an upper outer wedge having a top surface and a bottom surface, wherein the top surface of the upper outer wedge mates with a bottom surface of the upper inner barrel, and the bottom surface of the upper outer wedge includes three grooves;

an upper inner wedge having a top surface and a bottom surface, wherein the top surface of the upper inner wedge comprises three grooves such that, in an assembled configuration, the top surface of the upper inner wedge is mated with the bottom surface of the upper outer wedge, the three grooves in the bottom surface of the upper outer wedge align with the three grooves in the top surface of the upper inner wedge to define three upper through holes;

three upper fiber-reinforced polymer (FRP) tendons, each of the three upper FRP tendons located in a respective one of the three upper through holes;

a first middle wedge;

a first FRP plate located between a bottom surface of the upper inner wedge and a top surface of the first middle wedge;

a second middle wedge;

a second FRP plate located between a bottom surface of the first middle wedge and a top surface of the second middle wedge;

a lower inner wedge having a top surface and a bottom surface, wherein the bottom of the lower inner wedge surface comprises three grooves;

a third FRP plate located between a bottom surface of the second middle wedge and the top surface of the lower inner wedge;

a lower outer wedge having a top surface and a bottom surface, wherein the top surface of the lower outer wedge comprises three grooves such that, in the assembled configuration, the top surface of the lower outer wedge mates with the bottom surface of the lower inner wedge, the three grooves in the top surface of the lower outer wedge align with the three grooves in the bottom surface of the lower inner wedge to define three lower through holes;

three lower FRP tendons, each of the three lower FRP tendons located in a respective one of the three lower through holes; and a lower inner barrel having an outer surface conforming to and contacting the inner surface of the cylindrical outer barrel, the lower inner barrel comprising a top surface, wherein the top surface of the lower inner barrel mates with the bottom surface of the lower outer wedge, wherein the upper inner barrel has a thickness that varies in a longitudinal direction.

2. A wedge anchorage comprising:

a cylindrical outer barrel;

an upper inner barrel having an outer surface conforming to and contacting an inner surface of the cylindrical outer barrel;

an upper outer wedge having a top surface and a bottom surface, wherein the top surface of the upper outer wedge mates with a bottom surface of the upper inner barrel, and the bottom surface of the upper outer wedge includes three grooves;

an upper inner wedge having a top surface and a bottom surface, wherein the top surface of the upper inner wedge comprises three grooves such that, in an assembled configuration, the top surface of the upper inner wedge is mated with the bottom surface of the upper outer wedge, the three grooves in the bottom surface of the upper outer wedge align with the three grooves in the top surface of the upper inner wedge to define three upper through holes;

three upper fiber-reinforced polymer (FRP) tendons, each of the three upper FRP tendons located in a respective one of the three upper through holes;

a first middle wedge;

a first FRP plate located between a bottom surface of the upper inner wedge and a top surface of the first middle wedge;

a second middle wedge;

a second FRP plate located between a bottom surface of the first middle wedge and a top surface of the second middle wedge;

a lower inner wedge having a top surface and a bottom surface, wherein the bottom surface of the lower inner wedge comprises three grooves;

a third FRP plate located between a bottom surface of the second middle wedge and the top surface of the lower inner wedge;

a lower outer wedge having a top surface and a bottom surface, wherein the top surface of the lower outer wedge comprises three grooves such that, in the assembled configuration, the top surface of the lower outer wedge mates with the bottom surface of the lower inner wedge, the three grooves in the top surface of the lower outer wedge align with the three grooves in the bottom surface of the lower inner wedge to define three lower through holes;

three lower FRP tendons, each of the three lower FRP tendons located in a respective one of the three lower through holes; and a lower inner barrel having an outer surface conforming to and contacting the inner surface of the cylindrical outer barrel, the lower inner barrel comprising a top surface, wherein the top surface of the lower inner barrel mates with the bottom surface of the lower outer wedge, wherein the upper outer wedge has a thickness that varies in a longitudinal direction.

3. A wedge anchorage comprising:

a cylindrical outer barrel;

an upper inner barrel having an outer surface conforming to and contacting an inner surface of the cylindrical outer barrel;

an upper outer wedge having a top surface and a bottom surface, wherein the top surface of the upper outer wedge mates with a bottom surface of the upper inner barrel, and the bottom surface of the upper outer wedge includes three grooves;

an upper inner wedge having a top surface and a bottom surface, wherein the top surface of the upper inner wedge comprises three grooves such that, in an assembled configuration, the top surface of the upper inner wedge is mated with the bottom surface of the upper outer wedge, the three grooves in the bottom surface of the upper outer wedge align with the three grooves in the top surface of the upper inner wedge to define three upper through holes;

three upper fiber-reinforced polymer (FRP) tendons, each of the three upper FRP tendons located in a respective one of the three upper through holes;

a first middle wedge;

a first FRP plate located between a bottom surface of the upper inner wedge and a top surface of the first middle wedge;

a second middle wedge;

a second FRP plate located between a bottom surface of the first middle wedge and a top surface of the second middle wedge;

a lower inner wedge having a top surface and a bottom surface, wherein the bottom surface of the lower inner wedge comprises three grooves;

a third FRP plate located between a bottom surface of the second middle wedge and the top surface of the lower inner wedge;

a lower outer wedge having a top surface and a bottom surface, wherein the top surface of the lower outer wedge comprises three grooves such that, in the assembled configuration, the top surface of the lower outer wedge mates with the bottom surface of the lower inner wedge, the three grooves in the top surface of the lower outer wedge align with the three grooves in the bottom surface of the lower inner wedge to define three lower through holes;

three lower FRP tendons, each of the three lower FRP tendons located in a respective one of the three lower through holes; and a lower inner barrel having an outer surface conforming to and contacting the inner surface of the cylindrical outer barrel, the lower inner barrel comprising a top surface, wherein the top surface of the lower inner barrel mates with the bottom surface of the lower outer wedge, wherein the lower outer wedge has a thickness that varies in a longitudinal direction.

4. A wedge anchorage comprising:

a cylindrical outer barrel;

an upper inner barrel having an outer surface conforming to and contacting an inner surface of the cylindrical outer barrel;

an upper outer wedge having a top surface and a bottom surface, wherein the top surface of the upper outer wedge mates with a bottom surface of the upper inner barrel, and the bottom surface of the upper outer wedge includes three grooves;

an upper inner wedge having a top surface and a bottom surface, wherein the top surface of the upper inner wedge comprises three grooves such that, in an assembled configuration, the top surface of the upper inner wedge is mated with the bottom surface of the upper outer wedge, the three grooves in the bottom surface of the upper outer wedge align with the three grooves in the top surface of the upper inner wedge to define three upper through holes;

three upper fiber-reinforced polymer (FRP) tendons, each of the three upper FRP tendons located in a respective one of the three upper through holes;

a first middle wedge;

a first FRP plate located between a bottom surface of the upper inner wedge and a top surface of the first middle wedge;

a second middle wedge;

a second FRP plate located between a bottom surface of the first middle wedge and a top surface of the second middle wedge;

a lower inner wedge having a top surface and a bottom surface, wherein the bottom surface of the lower inner wedge comprises three grooves;

a third FRP plate located between a bottom surface of the second middle wedge and the top surface of the lower inner wedge;

a lower outer wedge having a top surface and a bottom surface, wherein the top surface of the lower outer wedge comprises three grooves such that, in the assembled configuration, the top surface of the lower outer wedge mates with the bottom surface of the lower inner wedge, the three grooves in the top surface of the lower outer wedge align with the three grooves in the bottom surface of the lower inner wedge to define three lower through holes;

three lower FRP tendons, each of the three lower FRP tendons located in a respective one of the three lower through holes; and a lower inner barrel having an outer surface conforming to and contacting the inner surface of the cylindrical outer barrel, the lower inner barrel comprising a top surface, wherein the top surface of the lower inner barrel mates with the bottom surface of the lower outer wedge, wherein the lower inner barrel has a thickness that varies in a longitudinal direction.

5. A wedge anchorage comprising:

a cylindrical outer barrel;

an upper inner barrel having an outer surface conforming to and contacting an inner surface of the cylindrical outer barrel;

an upper outer wedge having a top surface and a bottom surface, wherein the top surface of the upper outer wedge mates with a bottom surface of the upper inner barrel, and the bottom surface of the upper outer wedge includes three grooves;

an upper inner wedge having a top surface and a bottom surface, wherein the top surface of the upper inner wedge comprises three grooves such that, in an assembled configuration, the top surface of the upper inner wedge is mated with the bottom surface of the upper outer wedge, the three grooves in the bottom surface of the upper outer wedge align with the three grooves in the top surface of the upper inner wedge to define three upper through holes;

three upper fiber-reinforced polymer (FRP) tendons, each of the three upper FRP tendons located in a respective one of the three upper through holes;

a first middle wedge;

a first FRP plate located between a bottom surface of the upper inner wedge and a top surface of the first middle wedge;

a second middle wedge;

a second FRP plate located between a bottom surface of the first middle wedge and a top surface of the second middle wedge;

a lower inner wedge having a top surface and a bottom surface, wherein the bottom surface of the lower inner wedge comprises three grooves;

a third FRP plate located between a bottom surface of the second middle wedge and the top surface of the lower inner wedge;

a lower outer wedge having a top surface and a bottom surface, wherein the top surface of the lower outer wedge comprises three grooves such that, in the assembled configuration, the top surface of the lower outer wedge mates with the bottom surface of the lower inner wedge, the three grooves in the top surface of the lower outer wedge align with the three grooves in the bottom surface of the lower inner wedge to define three lower through holes;

three lower FRP tendons, each of the three lower FRP tendons located in a respective one of the three lower through holes; and a lower inner barrel having an outer surface conforming to and contacting the inner surface of the cylindrical outer barrel, the lower inner barrel comprising a top surface, wherein the top surface of the lower inner barrel mates with the bottom surface of the lower outer wedge, wherein at least one of the upper inner barrel, the upper outer wedge, the lower outer wedge, and the lower inner barrel have a thickness that varies in a longitudinal direction.

6. A wedge anchorage comprising:

a cylindrical outer barrel;

an upper inner barrel having an outer surface conforming to and contacting an inner surface of the cylindrical outer barrel;

an upper outer wedge having a top surface and a bottom surface, wherein the top surface of the upper outer wedge mates with a bottom surface of the upper inner barrel, and the bottom surface of the upper outer wedge includes three grooves;

an upper inner wedge having a top surface and a bottom surface, wherein the top surface of the upper inner wedge comprises three grooves such that, in an assembled configuration, the top surface of the upper inner wedge is mated with the bottom surface of the upper outer wedge, the three grooves in the bottom surface of the upper outer wedge align with the three grooves in the top surface of the upper inner wedge to define three upper through holes;

three upper fiber-reinforced polymer (FRP) tendons, each of the three upper FRP tendons located in a respective one of the three upper through holes;

a first middle wedge;

a first FRP plate located between a bottom surface of the upper inner wedge and a top surface of the first middle wedge;

a second middle wedge;

a second FRP plate located between a bottom surface of the first middle wedge and a top surface of the second middle wedge;

a lower inner wedge having a top surface and a bottom surface, wherein the bottom surface of the lower inner wedge comprises three grooves;

a third FRP plate located between a bottom surface of the second middle wedge and the top surface of the lower inner wedge;

a lower outer wedge having a top surface and a bottom surface, wherein the top surface of the lower outer wedge comprises three grooves such that, in the assembled configuration, the top surface of the lower outer wedge mates with the bottom surface of the lower inner wedge, the three grooves in the top surface of the lower outer wedge align with the three grooves in the bottom surface of the lower inner wedge to define three lower through holes;

three lower FRP tendons, each of the three lower FRP tendons located in a respective one of the three lower through holes; and a lower inner barrel having an outer surface conforming to and contacting the inner surface of the cylindrical outer barrel, the lower inner barrel comprising a top surface, wherein the top surface of the lower inner barrel mates with the bottom surface of the lower outer wedge, wherein each of the upper inner barrel, the upper outer wedge, the lower outer wedge, and the lower inner barrel have a thickness that varies in a longitudinal direction.

* * * * *